US006954183B2

(12) United States Patent
Solbach

(10) Patent No.: US 6,954,183 B2
(45) Date of Patent: Oct. 11, 2005

(54) SLOT ANTENNA ELEMENT

(75) Inventor: Klaus Solbach, Muelheim (DE)

(73) Assignee: EADS Deutschland GmbH, Munich (DE)

( * ) Notice: Subject to any disclaimer, the term of this patent is extended or adjusted under 35 U.S.C. 154(b) by 0 days.

(21) Appl. No.: 10/158,189

(22) Filed: May 31, 2002

(65) Prior Publication Data

US 2003/0001789 A1 Jan. 2, 2003

(30) Foreign Application Priority Data

May 31, 2001 (DE) ..... 101 26 469

(51) Int. Cl.[7] ..... H01Q 13/10
(52) U.S. Cl. ..... 343/771; 343/770; 343/767
(58) Field of Search ..... 343/770, 771, 343/767, 768, 772, 783

(56) References Cited

U.S. PATENT DOCUMENTS 2,818,565 A 12/1957 Ajioka et al.
2,948,895 A 8/1960 Ghose et al. ..... 343/767
3,015,100 A 12/1961 Rotman
4,554,550 A * 11/1985 Lopez ..... 343/771
4,873,528 A 10/1989 Girard
6,201,507 B1 * 3/2001 Park et al. ..... 343/771

FOREIGN PATENT DOCUMENTS

DE 1 959 159 4/1967
DE 33 10 531 A1 4/1986
DE 33 10 531 4/1986

* cited by examiner

*Primary Examiner*—James Clinger
(74) *Attorney, Agent, or Firm*—Crowell & Moring LLP

(57) ABSTRACT

A slot antenna element is provided in the form of a rectangular waveguide including at least one slot situated in the center of one broad side, a rectangular ridge arranged in the center of the interior surface of the other broad side, wherein the slot and the ridge each extend along the longitudinal direction of the waveguide, coupling devices, particularly a pin, arranged in the area of the slot, which excite the slot to emit electromagnetic energy, and compensation devices constructed on the surface of the ridge facing the slot, which compensation devices compensate the mismatch of the waveguide caused by the coupling devices with respect to the generator feeding the waveguide with electromagnetic energy. The compensation devices are constructed such that the ridge has a step-shaped indentation in the area of the slot.

13 Claims, 2 Drawing Sheets

SLOT ANTENNA ELEMENT

BACKGROUND AND SUMMARY OF THE INVENTION

This application claims the priority of German Application No. 101 26 469.0-35, filed May 31, 2001, the disclosure of which is expressly incorporated by reference herein.

The invention relates to a slot antenna element in the form of a rectangular waveguide.

Slot antenna elements, frequently used as antennas in high-frequency engineering applications, comprise a waveguide which extends in a longitudinal direction and has at least one slot for the emission of a portion of an electromagnetic wave guided in the waveguide. In the area of the slot, a pin consisting of a conductive material is often provided as a device for exciting the emission of the waveguide wave from the slot. Such a slot antenna is known, for example, from German patent document DE-GM 1 959 159. In the equivalent circuit diagram, this pin is represented by a first shunt-connected positive capacitance C1 at the waveguide.

However, from German patent document DE 33 10 531 A1, slot antenna elements are also known, in which case the waveguide is frequently provided with a ridge extending on the inside at the wall opposite the slot in the longitudinal direction of the waveguide.

In the special case of a symmetrically constructed rectangular ridge waveguide (in which a slot extending in the longitudinal direction of the waveguide as well as a ridge are arranged in the center with respect to the cross dimension of the waveguide), the above-mentioned pin made of a conductive material is a necessary means for exciting the emission of the waveguide wave from the slot. The operating principle consists of an asymmetrical distortion of the field distribution in the waveguide under the slot. In the equivalent circuit diagram, the slot-pin combination acts like a shunt-connected capacitor in parallel to a series-resonant circuit. For the compensation of the capacitor, an inductive diaphragm can be used in waveguide technique. However, its implementation is difficult in practice and furthermore itself causes a field distortion counterproductive to the excitation of the emission.

It is an advantage of the invention to provide an improved slot antenna element.

According to the invention, this advantage is achieved by providing a slot antenna element in the form of a rectangular waveguide. The slot antenna element includes at least one slot situated in the center of one broad side, a rectangular ridge arranged in the center of the interior surface of the other broad side. The slot and the ridge each extend along the longitudinal direction of the waveguide. A coupling device, particularly in the form of a pin, is arranged in the area of the slot, which excites the slot to emit electromagnetic energy, and a compensation device is constructed on the surface of the ridge facing the slot, which compensation device compensates the mismatch of the waveguide caused by the coupling device with respect to the generator feeding the waveguide with electromagnetic energy. The compensation device is constructed such that the ridge has a step-shaped indentation in the area of the slot. Advantageous further developments of the slot antenna element according to the invention are the object of dependent claims.

According to the invention, the slot antenna element in the form of a rectangular waveguide comprises:

a) at least one slot situated in the center of one broad side, b) a rectangular ridge arranged in the center of the interior surface of the other broad side, the slot and the ridge each extending along the longitudinal direction of the waveguide, c) coupling devices, particularly a pin, arranged in the area of the slot, which excite the slot to emit electromagnetic energy, and d) compensation devices constructed on the surface of the ridge facing the slot, which compensation devices compensate the mismatch of the waveguide caused by the coupling devices with respect to the generator feeding the waveguide with electromagnetic energy, the compensation devices being constructed such that the ridge has a step-shaped indentation in the area of the slot.

In an equivalent circuit representation, in which the slot of the waveguide is illustrated as a series-resonant circuit, the step-shaped indentation preferably represents a negative capacitance $C_2$ connected in parallel with respect to the series-resonant circuit.

The negative and the positive capacitance can be explained by means of field theory. Thus, the coupling device in the area of the slot represents a positive capacitance. Field-theoretically, the effect of the coupling device can be explained as a field distortion, predominantly of the electric field of the line. This results in an increase of the electric field energy around the coupling device, for example, a pin. In an equivalent circuit representation, this effect can be represented as a capacitance. Since the concentration of the electric field is increased, the capacitance is positive.

The ridge on the broad side of the waveguide opposite the slot can also be represented as a capacitance in an equivalent circuit. As a result of the step-shaped indentation of the ridge according to the invention, the ridge size is reduced. This causes a lowering of the electric field energy relative to a full size ridge. The capacitance therefore has a negative value.

According to a preferred embodiment of the invention, the devices for exciting the emission of the waveguide wave are formed by a pin made of a conductive material arranged laterally next to the slot.

With respect to the longitudinal direction of the waveguide, the pin is preferably arranged at the level of the center of the slot.

In a preferred embodiment, the step-shaped indentation has a rectangular cross-section of a length D and a height H parallel and/or perpendicular to the longitudinal direction of the ridge. The length D and the height H of the step-shaped indentation are preferably selected such that $C_1+C_2=0$ applies, wherein $C_1$ indicates the coupling devices to be represented as the capacitance $C_1$ in an equivalent circuit, and $C_2$ indicates the step-shaped indentation in the ridge to be represented as a negative capacitance $C_2$ in an equivalent circuit.

The step-shaped indentation and the slot are preferably arranged with respect to the longitudinal direction of the waveguide in the center relative to one another.

Other objects, advantages and novel features of the present invention will become apparent from the following detailed description of the invention when considered in conjunction with the accompanying drawings.

DETAILED DESCRIPTION OF THE DRAWINGS

Figure 1A:
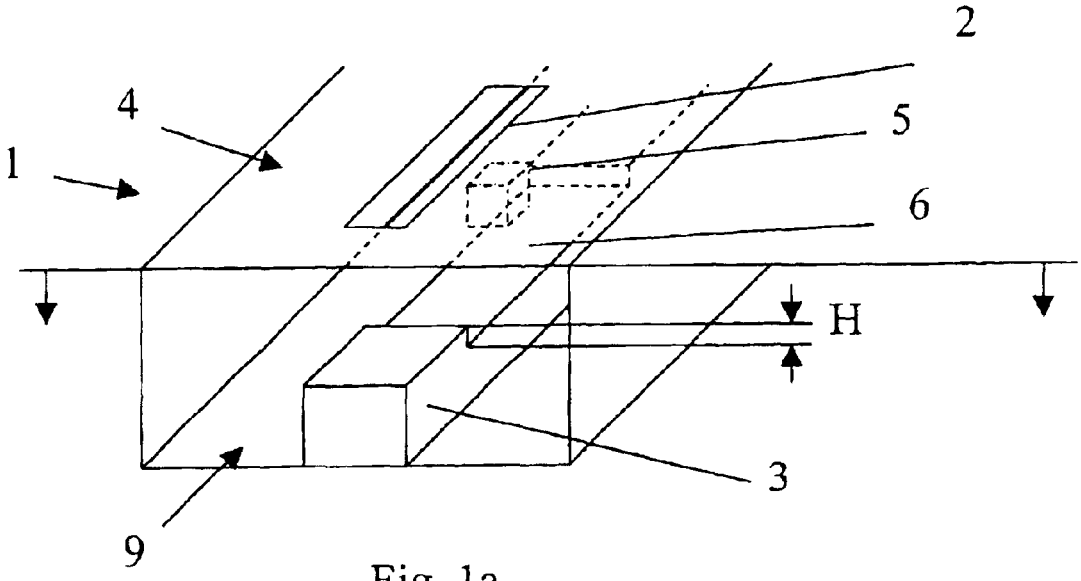
FIG. 1*a* is a perspective lateral view of a cutout of a slot antenna element according to an embodiment of the invention.
Figure 1B:
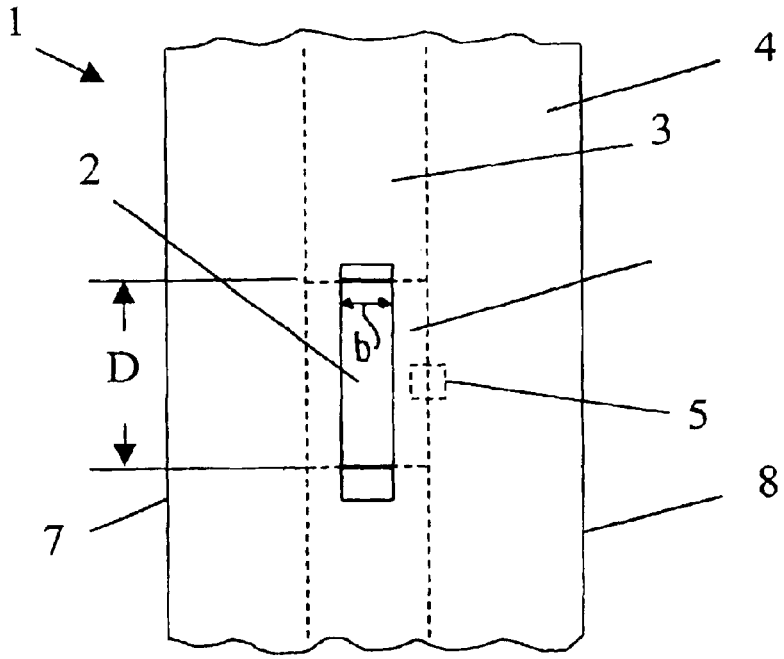
FIG. 1*b* is a top view of the embodiment of the slot antenna element according to the invention illustrated in FIG. 1*a*.

FIGS. 1*a* and 1*b* are cutouts of the slot antenna element in the form of a rectangular ridge waveguide with two broad sides 4, 9 and two narrow sides 7, 8. On its one (first) broad side 4, the waveguide 1 is provided with a slot 2, which slot 2 extends in the longitudinal direction of the waveguide 1. The slot 2 is used for emitting a portion of an electromagnetic wave guided in the waveguide. In the illustrated embodiment, the length of the slot 2 amounts to half the wavelength $\lambda/2$ of the working frequency, that is, the resonant frequency of the slot antenna element. Opposite the first broad side 4 of the rectangular waveguide, another (second) broad side 9 is situated, at whose interior side opposite the slot 2, a ridge 3 is provided. The ridge 3 also extends in the longitudinal direction of the waveguide 1. In the area of the slot 2, specifically viewed in the longitudinal direction of the waveguide 1, in its center, a pin 5 made of an electrically conductive material is arranged. The pin 5 forms devices for exciting the emission of the waveguide wave out of the slot 2. The pin 5 causes an asymmetrical distortion of the field distribution in the waveguide in the area of the slot, whereby the waveguide wave is permitted to exit the slot 2 for the emission. Without such devices for exciting the emission, a rectangular ridge waveguide of the illustrated type, in the case of which the slot 2 as well as the ridge extend in the waveguide center, would not emit.

Figure 2:
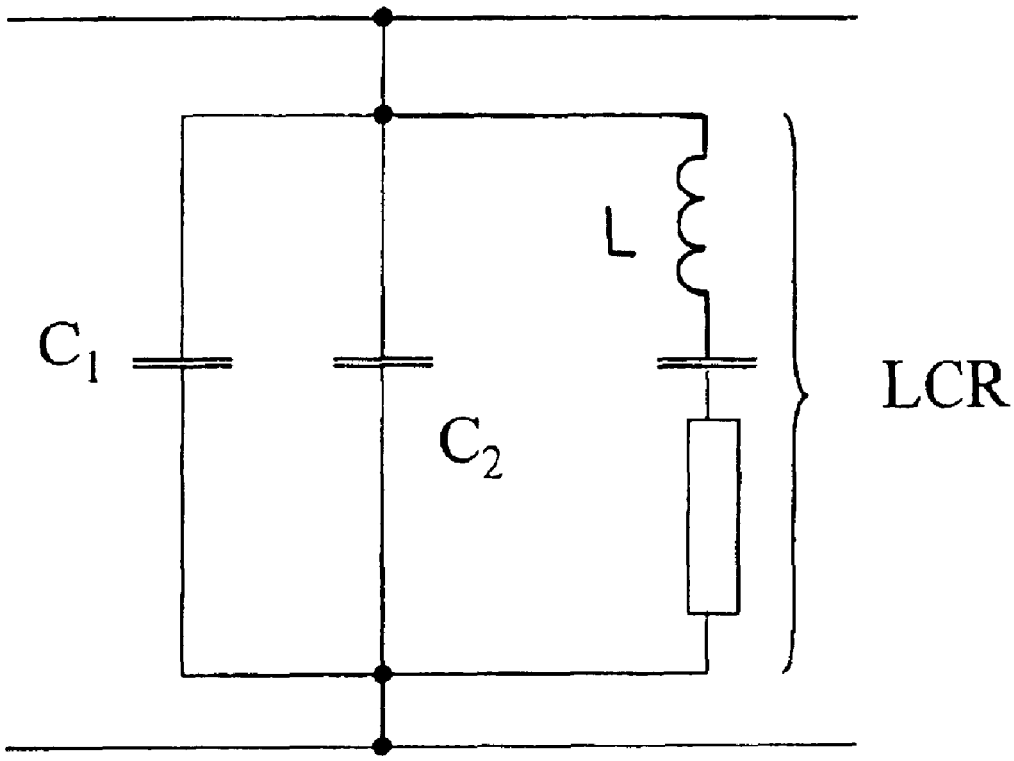
FIG. 2 is an equivalent circuit diagram of the slot antenna element of the invention according to FIGS. 1*a* and 1*b*.

In reference to FIG. 2, the pin 5 or, in a generalized manner, the devices for exciting the emission of the waveguide wave out of the slot 2, form a capacitance $C_1$ which is connected in parallel to a series-resonant circuit LCR representing the slot 2. The capacitance $C_1$ indicates a loading of this series-resonant circuit LCR with a capacitive reactance.

Referring again to FIGS. 1*a* and 1*b*, a step-shaped indentation 6 is constructed on the ridge 3 in the area of the slot 2. For the wave propagating in the waveguide 1, this step-shaped indentation 6 represents a second shunt-connected capacitance $C_2$, which at least partially compensates the first shunt-connected capacitance $C_1$ represented by the pin 5. Viewed from the side, the step-shaped indentation 6 has a rectangular shape of a length D and of a height H. Viewed transversely to the longitudinal direction of the waveguide 1, the step-shaped indentation 6, whose breadth B corresponds to that of the ridge 3, also has a rectangular cross-section. The length D and the height H of the step-shaped indentation 6 are selected such that the capacitance $C_1$ of the devices for exciting the emission from the slot 2 (the conductive pin 5) and the capacitance $C_2$ of the step-shaped indentation 6 just cancel each other out; thus, the equation $C_1+C_2=0$ applies. The step-shaped indentation 6 therefore has a resulting negative capacitance which is precisely opposite the (positive) capacitance of the devices, that is, of the pin 5, for exciting the emission from the slot 2.

The pin 5, which forms the devices for the emission from the slot 2, is arranged in the center of the slot 2 with respect to the longitudinal direction of the waveguide 1. Viewed transversely to the longitudinal direction of the waveguide 1, the ridge 3 has a rectangular cross-section, the breadth (width) B of the ridge 3 and thus also that of the step-shaped indentation 6, being larger than the breadth (width) b of the slot 2. The pin 5 arranged laterally next to the slot 2 is situated with its center approximately above the lateral boundary of the ridge 3. With respect to the longitudinal direction of the waveguide 1, the step-shaped indentation 6 is arranged in the center at the slot 2.

The resulting effect of the combined arrangement of the pin 5 forming the devices for the emission of the waveguide wave and of the step shape formed by the indentation 6 consists of an excitation of the emission of the waveguide wave out of the slot 2 without loading the circuit with a capacitive reactance.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A rectangular waveguide slot antenna element, comprising:

a rectangular waveguide;

at least one slot situated in a center of one broad side of the rectangular waveguide;

a rectangular ridge arranged in a center of an interior surface of the other broad side of the rectangular waveguide, wherein the slot and the ridge each extend along a longitudinal direction of the waveguide;

a coupler arranged in an area of the slot, the coupler exciting the slot to emit electromagnetic energy; and a compensating device constructed on a surface of the rectangular ridge facing the slot, the compensating device compensating mismatch of the waveguide caused by the coupler with respect to a generator feeding the electromagnetic energy, the compensating device being constructed as a step-shaped indentation in the rectangular ridge in an area of the slot.

2. The slot antenna element according to claim 1, wherein the coupler is a pin.

3. The slot antenna element according to claim 1, wherein in an equivalent circuit representation in which the slot is represented as a series-resonant circuit, the step-shaped indentation is a negative capacitance connected in parallel to the series-resonant circuit.

4. The slot antenna element according to claim 1, wherein the coupler is a pin made of a conductive material, the pin being arranged laterally next to the slot.

5. The slot antenna element according to claim 3, wherein the coupler is a pin made of a conductive material, the pin being arranged laterally next to the slot.

6. The slot antenna element according to claim 4, wherein the pin is arranged at a level of a center of the slot.

7. The slot antenna element according to claim 5, wherein the pin is arranged at a level of a center of the slot.

8. The slot antenna element according to claim 4, wherein a center of the pin is arranged essentially above a lateral boundary of the ridge.

9. The slot antenna element according to claim 6, wherein a center of the pin is arranged essentially above a lateral boundary of the ridge.

10. The slot antenna element according to claim 1, wherein the step-shaped indentation has a rectangular cross-section arranged with one dimension parallel and one dimension perpendicular to the longitudinal direction of the ridge, the step-shaped indentation having a length D in the longitudinal direction and a height H in a direction perpendicular to the longitudinal direction.

11. The slot antenna element according to claim 10, wherein the step-shaped indentation and the slot are arranged in a center relative to one another with respect to the longitudinal direction of the waveguide.

12. The slot antenna element according to claim 10, wherein the length D and the height H of the step-shaped indentation are selected such that the equation $C_1+C_2=0$ applies, with the coupler to be represented in an equivalent circuit as the positive capacitance $C_1$, and the step-shaped indentation in the ridge to be represented in the equivalent line circuit as a negative capacitance $C_2$.

13. The slot antenna element according to claim 11, wherein the length D and the height H of the step-shaped indentation are selected such that the equation $C_1+C_2=0$ applies, the coupler to be represented in an equivalent line circuit as the positive capacitance $C_1$, and the step-shaped indentation in the ridge to be represented in the equivalent circuit as a negative capacitance $C_2$.

* * * * *